US009730493B2

(12) United States Patent
Teifer

(10) Patent No.: US 9,730,493 B2
(45) Date of Patent: Aug. 15, 2017

(54) ELASTIC CLOSURE FOR FOOTWEAR

(71) Applicant: NIKKI BEANS, LLC., Alexandria, VA (US)

(72) Inventor: Jennifer Teifer, Alexandria, VA (US)

( * ) Notice: Subject to any disclaimer, the term of this patent is extended or adjusted under 35 U.S.C. 154(b) by 322 days.

(21) Appl. No.: 14/169,117

(22) Filed: Jan. 30, 2014

(65) Prior Publication Data

US 2014/0208615 A1 Jul. 31, 2014

Related U.S. Application Data

(60) Provisional application No. 61/758,791, filed on Jan. 31, 2013.

(51) Int. Cl.
*A43C 11/00* (2006.01)
*A43C 11/14* (2006.01)
(Continued)

(52) U.S. Cl.
CPC ..... *A43C 11/1493* (2013.01); *A43C 11/002* (2013.01); *A43C 11/006* (2013.01);
(Continued)

(58) Field of Classification Search
CPC ..... A43C 11/002; A43C 11/006; A43C 11/02; A43C 11/04; A43C 11/06; A43C 11/08; A43C 11/14; A43C 11/20; A43C 11/22
(Continued)

(56) References Cited

U.S. PATENT DOCUMENTS 450,510 A * 4/1891 Heuser ..... A44B 1/24
24/114.8
715,599 A * 12/1902 Pitts ..... A43C 1/02
24/713.1

(Continued)

FOREIGN PATENT DOCUMENTS

| | | |
|---|---|---|
| CN | 202760335 U | 3/2013 |
| GB | 837374 | 6/1960 |
| GB | 2462473 A | 2/2010 |

OTHER PUBLICATIONS

Make It Do, Feb. 3, 2010, http://www.make-it-do.com/tag/hair-accessories-with-buttons/.*

(Continued)

*Primary Examiner* — Clinton T Ostrup
*Assistant Examiner* — Cameron A Carter
(74) *Attorney, Agent, or Firm* — Richard C. Litman

(57) ABSTRACT

The elastic closure for footwear is a releasable closure for an open upper of an article of footwear. The elastic closure includes an elastomeric loop having opposed first and second ends, an anchoring member, such as a button, secured to the first end of the elastomeric loop, and an aglet secured to and covering the second end of the elastomeric loop. In use, the aglet and the second end of the elastomeric loop are inserted from above through a first eyelet of an upper of the article of footwear, so that the aglet and the second end of the elastomeric loop may be drawn through a second eyelet of the upper from below. The button prevents the first end of the elastomeric loop from passing through the first eyelet. The second end of the elastomeric loop is then stretched across the upper and releasably secured about the button.

6 Claims, 4 Drawing Sheets

(51) Int. Cl.

| | |
|---|---|
| ***A43C 11/02*** | (2006.01) |
| ***A43C 11/06*** | (2006.01) |
| ***A43C 11/20*** | (2006.01) |
| ***A43C 11/08*** | (2006.01) |
| ***A43C 11/04*** | (2006.01) |
| ***A43C 11/22*** | (2006.01) |

(52) U.S. Cl.
CPC ..... *A43C 11/02* (2013.01); *A43C 11/04* (2013.01); *A43C 11/06* (2013.01); *A43C 11/08* (2013.01); *A43C 11/14* (2013.01); *A43C 11/20* (2013.01); *A43C 11/22* (2013.01)

(58) Field of Classification Search
USPC ..... 36/51, 50.1
See application file for complete search history.

(56) References Cited

U.S. PATENT DOCUMENTS 1,336,146 A * 4/1920 McDonald ..... A43C 11/02 24/40
1,691,453 A * 11/1928 Alterson ..... A43C 11/02 24/312
1,772,673 A 8/1930 MacDonald
2,289,225 A * 7/1942 Tonai ..... A43C 11/22 24/300
2,608,691 A * 9/1952 Berg ..... A41F 17/00 2/325
2,899,731 A * 8/1959 Maxim ..... A43C 11/02 24/660
2,952,315 A * 9/1960 Brontman ..... A47H 13/00 160/330
3,099,271 A * 7/1963 Dubelier ..... A45D 8/34 132/273
3,751,769 A * 8/1973 Reiner ..... A45D 8/34 132/273
4,043,006 A * 8/1977 Williams ..... A44B 1/00 24/102 E
RE30,701 E * 8/1981 Williams ..... A41D 27/201 24/102 E
4,918,840 A * 4/1990 Nardulli ..... A43C 11/12 36/50.1
6,438,871 B1 * 8/2002 Culverwell ..... A43C 11/00 24/578.14
6,701,589 B1 3/2004 Kliewer
7,506,420 B2 * 3/2009 Frydlewski ..... A43C 11/00 24/713
D686,909 S * 7/2013 Frydlewski ..... D2/978
8,850,667 B2 * 10/2014 Casubolo ..... A41F 1/02 24/102 E
9,247,785 B1 * 2/2016 Kacines ..... A44B 1/24
9,468,270 B2 * 10/2016 Malamphy ..... A44C 5/0053
2002/0078597 A1 * 6/2002 Burt ..... A43B 7/12 36/51
2004/0237348 A1 * 12/2004 Lacey ..... A43B 3/08 36/54
2005/0081403 A1 * 4/2005 Mathieu ..... A43C 1/00 36/50.1
2005/0126041 A1 * 6/2005 Gonzalez Palacio A43B 3/0078 36/50.1
2005/0183250 A1 * 8/2005 Tricker ..... A43C 9/06 24/713
2006/0005429 A1 * 1/2006 Min ..... A43C 1/003 36/50.1
2006/0179685 A1 * 8/2006 Borel ..... A43C 7/00 36/50.1
2011/0035961 A1 * 2/2011 Volin ..... A43B 3/0078 36/54
2011/0099843 A1 * 5/2011 Jung ..... A43C 1/06 36/50.1
2012/0192383 A1 * 8/2012 Casubolo ..... A41F 1/02 24/114.7
2013/0097887 A1 4/2013 Robinson
2013/0255046 A1 * 10/2013 Talley ..... A43C 1/02 24/715.3
2014/0290015 A1 * 10/2014 Barron ..... A43C 1/00 24/712.4

OTHER PUBLICATIONS

Hickies Elastic Lacing System; printed from http://www.brookstone.com/hickies-elastic-shoelaces on Dec. 9, 2013; 2 pages.

* cited by examiner

ELASTIC CLOSURE FOR FOOTWEAR

CROSS-REFERENCE TO RELATED APPLICATION

This application claims the benefit of U.S. Provisional Patent Application Ser. No. 61/758,791, filed Jan. 31, 2013.

BACKGROUND OF THE INVENTION

1. Field of the Invention

The present invention relates to accessories for footwear, and particularly to an elastic closure for footwear that provides a replacement for conventional shoelaces.

2. Description of the Related Art

Shoelaces are commonly used to secure shoes, boots and other footwear. They typically consist of a pair of strings or cords, one for each shoe, finished off at both ends with stiff sections, known as aglets. Each shoelace typically passes through a series of holes, eyelets, loops or hooks on either side of the shoe. Loosening the lacing allows the shoe to open wide enough for the foot to be inserted or removed. Tightening the lacing and tying off the ends secures the foot within the shoe.

Shoelaces are typically tied off at the top of the shoe using a simple bow knot. The common bow consists of two half knots tied one on top of the other, the second half-knot being looped in order to allow for quick untying. When required, the knot can be readily loosened by pulling one or both of the loose ends. Although the bow knot is a relatively simple knot, it requires a certain degree of manual dexterity to properly tie. Children, the developmentally disabled, the infirm, the disabled or the injured may have great difficulty in tying shoes using this method.

Thus, an elastic closure for footwear solving the aforementioned problems is desired.

SUMMARY OF THE INVENTION

The elastic closure for footwear is a releasable closure for an open upper of an article of footwear. The elastic closure includes an elastomeric loop having opposed first and second ends, an anchoring member, such as a button or the like, secured to the first end of the elastomeric loop, and an aglet secured to and covering the second end of the elastomeric loop. In use, the aglet and the second end of the elastomeric loop are inserted from above through a first eyelet of an upper of an article of footwear so that the aglet and the second end of the elastomeric loop may be drawn through a second eyelet of the upper from below the eyelet. The second end of the elastomeric loop may then be stretched across the upper and releasably secured about the anchoring member to releasably close the upper. The anchoring member prevents the first end of the elastomeric loop from passing through the first eyelet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
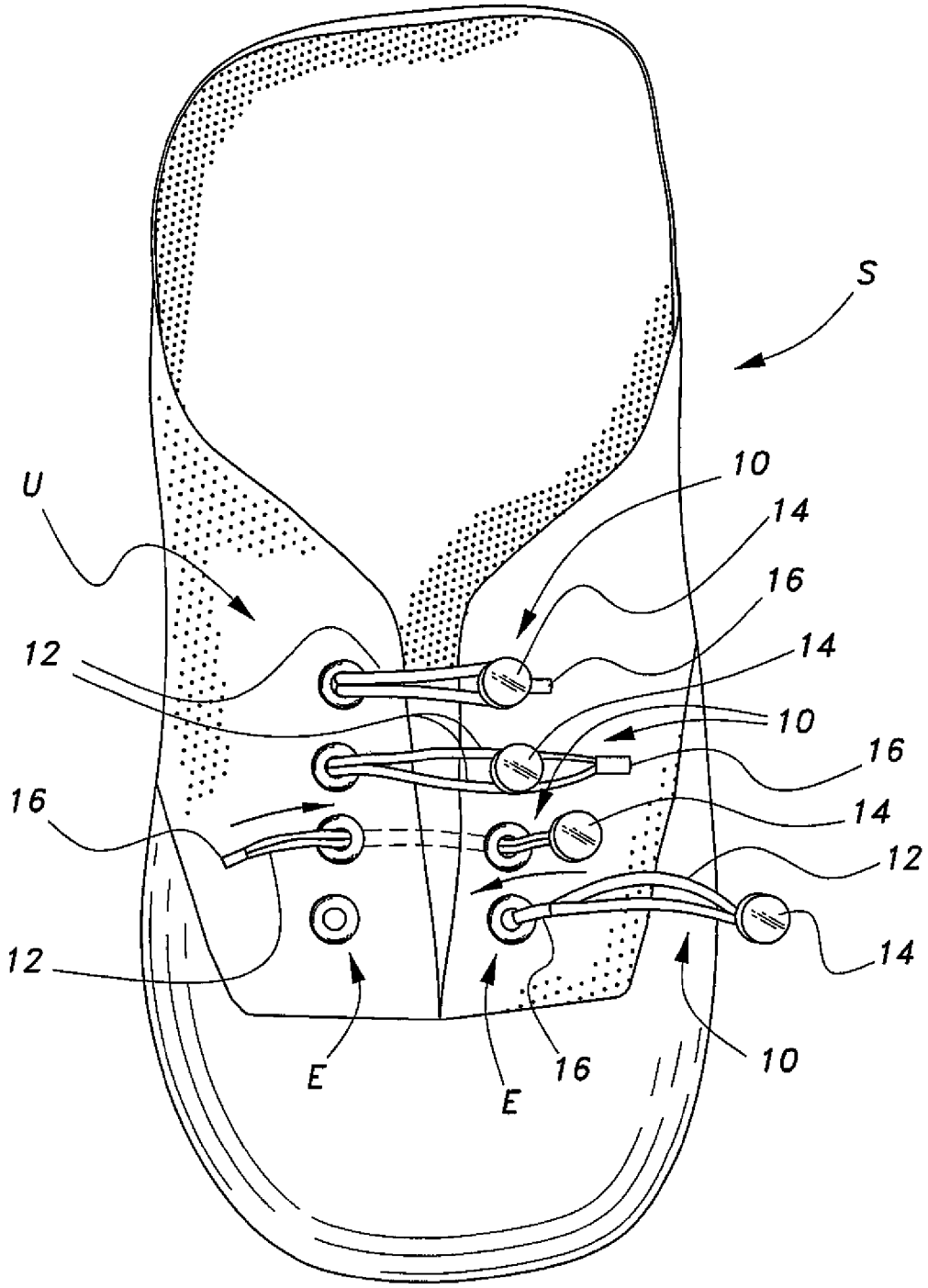
FIG. 1A is an environmental, perspective view of an elastic closure for footwear according to the present invention, showing a shoe with four of the closures in various stages of being inserted and fastened to the shoe.
Figure 1B:
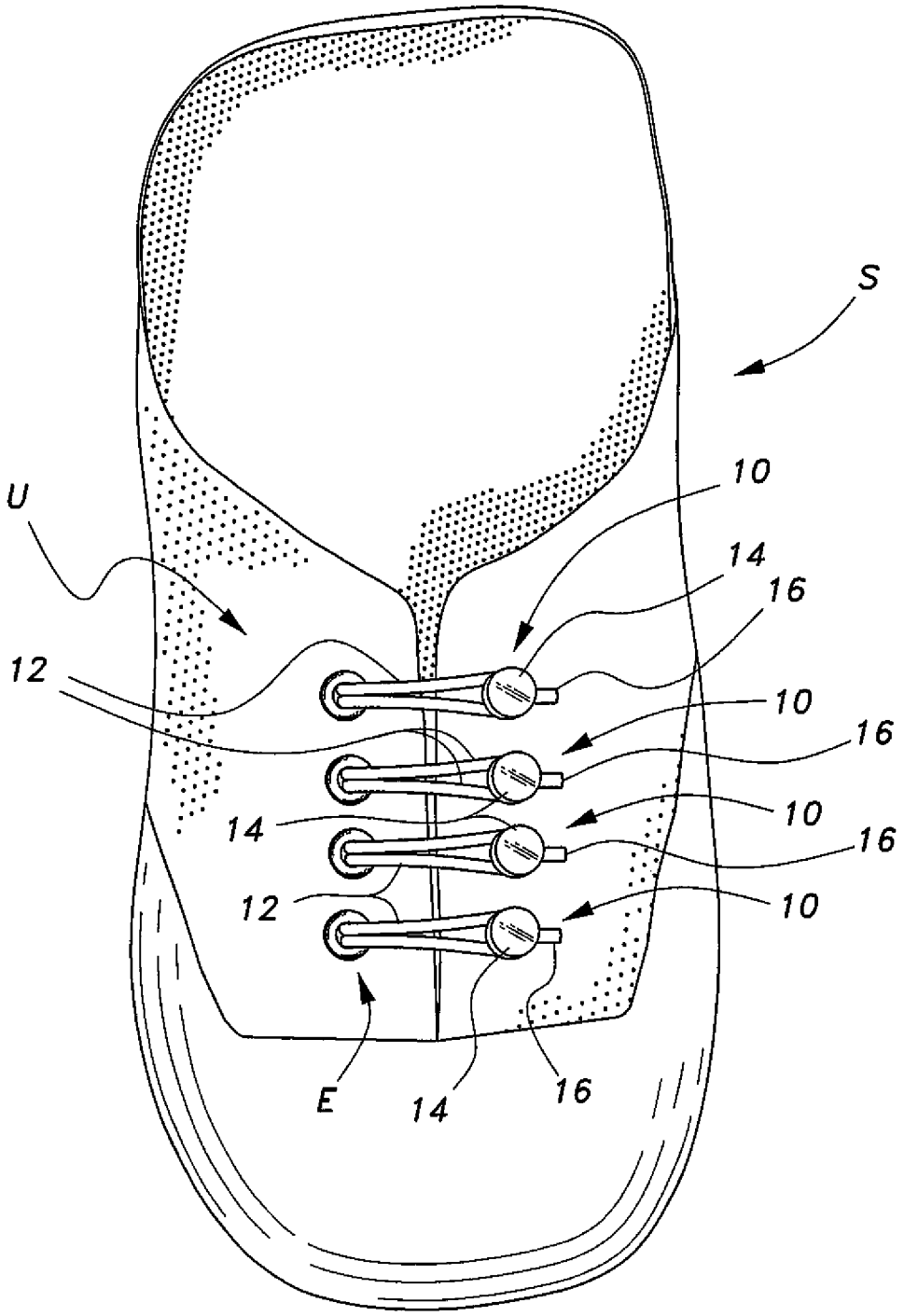
FIG. 1B is an environmental, perspective view of the elastic closure for footwear according to the present invention, showing the shoe of FIG. 1 with all four closures fastened.
Figure 2:
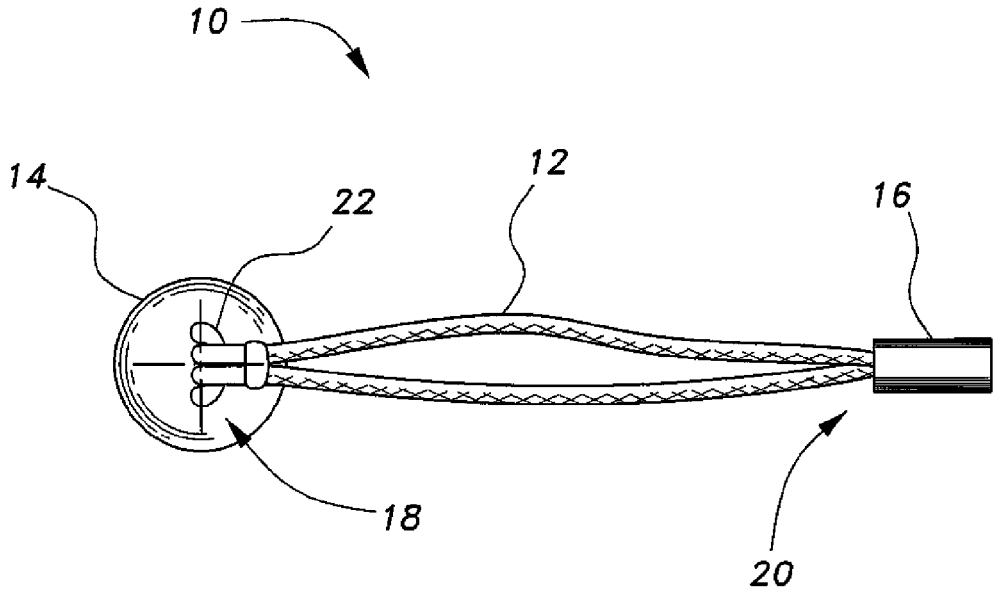
FIG. 2 is a bottom view of the elastic closure for footwear according to the present invention.
Figure 4:
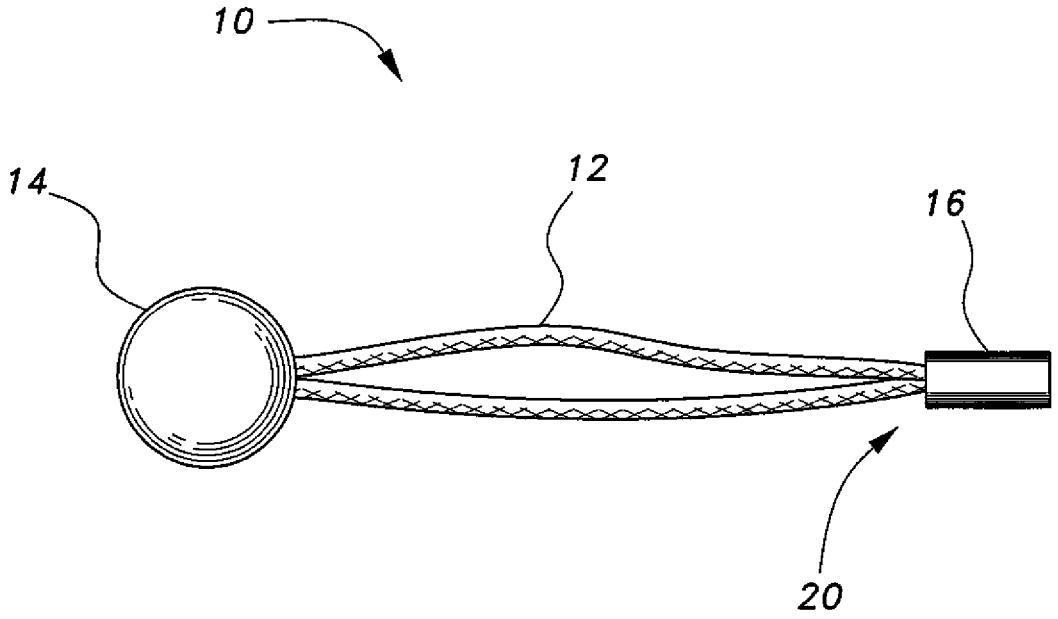
FIG. 4 is a top view of the elastic closure for footwear according to the present invention.

Referring to FIGS. 1A and 1B, the elastic closure for footwear 10 is a releasable closure for an open upper U of an article of footwear, such as exemplary shoe S. As best seen in FIGS. 2 and 4, the elastic closure 10 includes an elastomeric loop 12 having opposed first and second ends 18, 20, respectively, a button 14 secured to the first end 18 of the elastomeric loop 12, and an aglet 16 secured to and covering the second end 20 of the elastomeric loop 12. It should be understood that the shoe S shown in FIGS. 1A and 1B is shown for exemplary purposes only, and that the elastic closure 10 may be used in combination with any desired article of footwear having eyelets E formed through an upper U, such as sneakers, walking shoes, athletic shoes, boots, Oxford-style shoes, roller skates and the like. It should further be understood that the elastic closure 10 may also be used as a releasable closure for backpacks, bags or any other article having an open end requiring a releasable closure. Additionally, it should be understood that the button 14 is shown for exemplary purposes only, and that the button 14 may be replaced by any suitable type of anchoring member or stopping member, such as clasps, hooks, loops, snaps, clips, buckles, other types or styles of buttons or similar articles, etc.

As best shown in FIG. 1A, in use, the aglet 16 and the second end 20 of the elastomeric loop 12 are inserted from above through a first one of the eyelets E of the upper U of the exemplary shoe S so that the aglet 16 and the second end 20 of the elastomeric loop 12 may be drawn through a second one of the eyelets E of the upper U from below the eyelet E. As shown, similar to conventional lacing of shoes and the like, the first and second eyelets are preferably aligned with one another. The button 14 prevents the first end 18 of the elastomeric loop 12 from passing through the first of the eyelets E. The second end 20 of the elastomeric loop 12 may then be stretched across the upper U above the tongue of the shoe S and releasably secured about the button 14. A plurality of closures 10 may be secured between opposing pairs of eyelets E to releasably close the upper U, thereby securing the shoes S about the user's foot. The elastic nature of the elastomeric loop 12 holds the second end 20 securely about the button 14, and also allows the user to easily release the second end 20 from the button 14 when the user desires to remove the footwear. Alternatively, the user may remove the shoe S by simply holding the shoe S and lifting his/her foot out of the shoe S, since the elastic closures 10 resiliently stretch sufficiently to allow the user to remove the foot from the shoe S (and to insert the foot into the shoe S) without unfastening the closures 10.

As shown in FIGS. 1A and 1B, one such elastic closure 10 is preferably provided for each pair of aligned eyelets E. However, it should be understood that elastic closures 10 may be used in any desired manner, for example, crisscrossing between non-aligned eyelets, etc.

It should be understood that the button 14 may be any suitable type of button or other type of stopping element that is greater in size than the eyelets E, preventing passage of the first end 18 of elastomeric loop 12 through the corresponding eyelet E. The button 14 may be provided with any desired decoration or decorative elements, as well as functional items, such as informational or identification indicia, instructions for children or the developmentally disabled, or the like.

Figure 3:
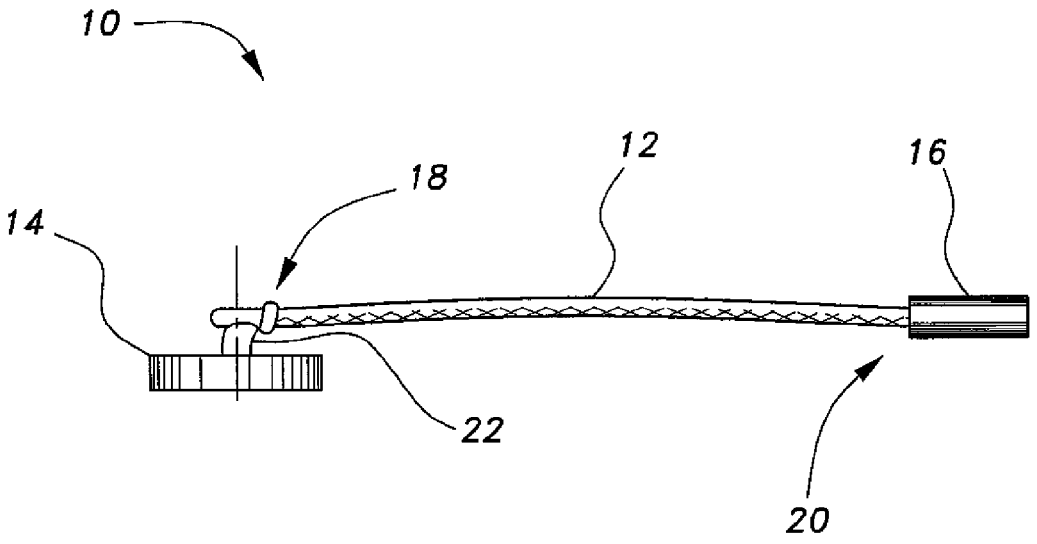
FIG. 3 is a side view of the elastic closure for footwear according to the present invention.

In one method of manufacture of the elastic closure 10, an elastic or elastomeric cord is cut to the desired length and then folded in half. The folded, looped portion will become the first end 18 and the free ends, when joined together, will form the second end 20 of the elastomeric loop 12. The free ends are inserted into a U-shaped metal tube bead or the like and are secured to one another (and secured within the metal tube) by a non-toxic adhesive or the like. The metal tube bead is then crimped to form the aglet 16 and to secure the second end 20 therein. With regard to the opposite end; i.e., the looped first end 18 of the elastomeric loop 12, the first end 18 is secured to the anchoring member, which, as shown in FIGS. 2 and 3, may be exemplary shank button 14, with first end 18 being tied thereto or otherwise secured via any conventional manner. It should be understood that the first end 18 may be secured to the button 14 by any desired manner, and similarly, the aglet 16 may be secured to the second end 20 by any suitable process.

It should be understood that the elastomeric loop 12 may be formed from any suitable type of resilient, elastic or elastomeric material, such as an elastic cord having a rubber polymer core enclosed within a woven cotton sheath. The cotton sheath may also be formed with an ornamental or decorative pattern, if desired. Alternatively, the elastomeric loop 12 may be formed from any suitable material, such as a rubber O-ring or seal, a hair band, molded rubber, a heavyweight rubber band, elastic tape, a manufactured circular elastomeric fastener, or the like.

The elastomeric loop 12 allows for the releasable holding together of the opposing sides of the upper U to fasten the user's foot therein without the use of shoelaces. The elastic nature of loop 12 allows the upper U to conform to the shape of the foot, as the polymers of the elastomeric material independently deform according to the range of force applied on the polymer cores by the shoe and inserted foot. Through reversible deformation, the amorphous elastic polymers continue to reconfigure themselves independently of one another to shape the upper U to conform to the shape of the inserted foot when the foot is in motion, according to the range of force applied thereon.

Further, the elastomers resiliently expand and contract with applied force to allow the user to comfortably insert and remove the foot without the need to tie, untie, tighten and/or loosen shoelaces so that the user can use a shoe that is designed for lacing as a slip-on type shoe. The elastomers return to their original relative shape when any applied force is removed due to their memory capacity. It should also be understood that the elastomeric loop 12 may be used as a decorative element, and may be manufactured in a variety of differing shapes, sizes, colors and textures.

As noted above, any suitable type of elastic or elastomeric cord may be used for the manufacture of the elastomeric loop 12. As an example, a flat, durable, heavyweight elastic cord may be utilized, having a width, for example, of about one-eighth of an inch, and a length of about 4.5 to 6.5 inches. It should be understood that the cord may have any desired dimensions. However, the length should be sufficient so that some measure of force is applied on the elastomeric material when the closure 10 is in use. The length of the elastomeric loop 12 is ultimately dependent on the width of the user's foot and the size and style of footwear.

With regard to the aglet 16, the aglet 16 securely holds the second end 20 of the elastomeric loop 12 to maintain the second end 20 in the desired closed, looped configuration. The aglet 16 further keeps the fibers forming the elastomeric loop 12 from fraying or unraveling at the second end 20 of the loop, and aids and simplifies the process of inserting the second end 20 through the eyelet. The aglet 16 may also serve as a decorative element, and may include any desired type of decoration or ornamentation.

As described above, the aglet 16 may be formed from a small piece of metal, such as a U-shaped tube or bead formed from a modified crimp end tip (commonly referred to as a "fold over cord end" or "end cap cord tip"), similar to that which is well known in jewelry making. The crimp end tip is modified by removing the eyelet, which produces a small U-shaped piece of metal that resembles a small tube bead that is cut in half lengthwise. In order to form the tube bead into aglet 16 and secure it to the elastomer, the free ends of the elastomeric cord are placed lengthwise inside the tube bead such that the ends of the cord are flush with the distal end of the tube bead. This "double-threaded aglet" allows first and second portions of the second end of the elastomeric loop to both be held securely within single aglet 16. As described above, a non-toxic glue or other adhesive may then be applied inside the tube bead at this open distal end. A special crimping tool with a dull metal blade or shaft on the top side and with a rounded underside is then placed over the tube bead and the inserted portion of the elastomer. When the tool is depressed, the tube bead wraps around the inserted portion of the elastomer and collapses around it. The upper blade depresses downward and comes in pressure contact with the tube bead, which, with applied force, collapses the upper ends of the tube bead downward and folds the edges into the elastomer. The result is a collapsed oval or circular tube with a circumference of approximately 1 to 2 mm, which securely grasps the inserted portion of the elastomer so the free ends of the cord cannot be easily separated. The adhesive reinforces this connection.

It should be understood that the aglet 16 may be formed from any desired material, such as silver-plated brass. Although the aglet 16 may have any desired dimensions, an exemplary length for the tube bead may be about 11 mm in length, a corresponding outer diameter of about 3.5 mm, an inner diameter of about 3 mm, and a wall thickness of about 0.5 mm. The dimensions may vary, so that the length of the tube bead ranges between 2.5 mm and 15 mm, the diameter ranges between 2 mm and 4 mm, and the wall thickness ranges between 0.5 mm and 0.75 mm.

The aglet wall may have any desired thickness, although the inner diameter of the eyelet E must be larger than the finished aglet 16. Alternatively, a slightly larger finished aglet may be used if the eyelet opening is made of a material that allows the opening to expand to permit insertion of the aglet 16 through the eyelet E. The fibers of thread, leather, canvas, or any of the materials from which shoes and eyelets are commonly made may expand to accommodate a slightly larger aglet. An eyelet opening that is fitted with a grommet, typically formed of metal, hard plastic, or any other rigid material, and which has a smaller diameter than the aglet will prevent the insertion of the aglet through the eyelet opening. When crimped, a tube bead with a greater wall thickness will result in an aglet of a larger diameter, which may prevent its use in shoes having smaller eyelet openings.

As noted above, the aglet may be formed from metal. Such metals include, but are not limited to, aluminum, zinc, tin, copper, brass, precious metals, monkey metal, or a pot metal alloy. Preferably, the selected metal is not relatively hard, relatively soft or relatively brittle. Further, lead and other toxic and/or volatile metals should preferably be avoided, due to the risk of poisoning, particularly with children.

It should be understood that the aglet may be formed and sealed to the second end 20 in any desired manner. For example, a hollow closed metal tube bead may be used, as well as aglets similar to those on conventional shoelaces. As an alternative to metal, plastic, rubberized plastic, rubber, acetate film, glue, glass, stone, sea shell, adhesive tape, wax, resin, thread, paper, heat shrink wrap, or the like may also be used. As further alternatives, the second end 20 may be knotted or melted together to form a bead that can be threaded through the eyelets E. It should be understood that the aglet 16 may be replaced by any suitable type of device or element that allows the user to easily grasp the second end 20 and thread it through eyelets E, including bars, toggles, jump rings, or barbs.

With regard to the button 14, the button 14 serves to releasably secure the first and second ends 18, 20 together, and further serves to anchor the first end 18 of the elastomeric loop 12 to one of the eyelets E, preventing accidental passage of the first end therethrough. Additionally, the upper surface of the button 14 provides ample space for any desired ornamentation or decoration. The button 14 may be any desired type of button or stop, for example, a shank button. As shown in FIGS. 2 and 3, a shank button includes a small shank device 22 on the underside of the button 14 that provides a small amount of space between the upper U and the lower surface of the button 14. The shank 22 also provides a small eyelet to easily attach the elastomeric cord (forming first end 18 of the elastomeric loop 12) directly to the button 14. When installed on the shoe S, the upper surface of the shank button 14 conceals the attachment of the elastic member to the shank 22, which is preferred for the closure's decorative appearance.

The shank button 14 may have any desired shape or relative dimensions. Typical exemplary dimensions include diameters ranging between about 0.25 and 0.75 inches. The button 14 may have any desired shape or size, may include any desired decorative elements, and may be formed from any desired material having any desired color or texture. In addition to decoration or ornamentation applied to the button 14, the button itself may be manufactured in any desired shape, e.g., a skull, a butterfly, a smiley face, a lady bug, a music note, a rounded ball, or the like.

Typical buttons are manufactured from plastic, rubberized plastic, metal or wood, although it should be understood that the button 14 may be made from any desired material, such as silicone, embroidery, sea shell, or bone. Any type of decorative element or indicia may be applied to the upper surface of the button 14, such as memory or learning aids.

As described above, the elastomeric cord may be attached to the shank 22 of the button 14 by a loop knot or the like. It should be understood that the first end 18 may be secured to the button 14 by any suitable method, such as tying the end 18 to eyelets of a conventional button, glue or other adhesives, or the like.

In the above description, the elastomeric loop 12 forms the main body portion of the closure 10. It should be understood that the loop 12 may be replaced by any relatively linear, elastic element, such as a single elastic or elastomeric cord. Additionally, although the closure 10 has been illustrated and described by reference to a button 14, it will be understood that any suitable anchoring member or stopping member that is large enough in diameter to prevent passage of the first end 18 of the loop 12 through the eyelet E may be used, including a snap, hook, loop, clip, clasp, buckle, knob, or the like.

It is to be understood that the present invention is not limited to the embodiments described above, but encompasses any and all embodiments within the scope of the following claims.

I claim:

1. An article of footwear in combination with an elastic closure, comprising:

an article of footwear having an upper, the upper having a plurality of eyelets formed therethrough; and a plurality of elastic closures, each of the closures including a continuous elastomeric loop having a closed first and a second longitudinally opposed end;

an anchoring member, the anchoring member having a top surface and a bottom surface, the anchoring member being secured directly to the first end of the elastomeric loop, wherein the anchoring member includes a shank extending from the bottom surface thereby defining a space therebetween, further wherein the first end of the elastomeric loop is disposed within the space and is secured to the shank; and an aglet secured to and covering the second end of the elastomeric loop, wherein the aglet and the second end of the elastomeric loop are dimensioned and configured for insertion from above through a first one of the eyelets of the upper of the article of footwear so that the aglet and the second end of the elastomeric loop may then be drawn through a second one of eyelets of the upper from below the second one of the eyelets, the anchoring member preventing the first end of the elastomeric loop from passing through the first one of the eyelets, the second end of the elastomeric loop being stretched across the upper and releasably secured about the anchoring member to releasably close the upper, a plurality of pairs of the eyelets having a corresponding one of the elastic closures fastened across the eyelets to resiliently retain the footwear on the foot of a user.

2. The article of footwear in combination with an elastic closure as recited in claim 1, wherein said anchoring member comprises a shank button.

3. The article of footwear in combination with an elastic closure as recited in claim 1, wherein said anchoring member is selected from the group consisting of a snap, a clip, a hook, a loop, a clip, a clasp, a buckle and a button.

4. A method of releasably closing an open upper of an article of footwear, comprising the steps of:

providing an elastic closure, the elastic closure including:

a continuous elastomeric loop having a closed first end and a second longitudinally opposed end;

an anchoring member, the anchoring member having a top surface and a bottom surface, the anchoring member being secured directly to the first end of the elastomeric loop, wherein the anchoring member includes a shank extending from the bottom surface thereby defining a space therebetween, further wherein the first end of the elastomeric loop is disposed within the space and is secured to the shank, and an aglet secured to and covering the second end of the elastomeric loop;

inserting the aglet and the second end of the elastomeric loop from above through a first eyelet of an upper of an article of footwear;

drawing the aglet and the second end of the elastomeric loop through a second eyelet of the upper from below the eyelet, the anchoring member preventing the first end of the elastomeric loop from passing through the first eyelet; and stretching the elastic loop across the upper and releasably securing the second end of the elastomeric loop about the anchoring member.

5. The method of releasably closing an open upper of an article of footwear as recited in claim 4, wherein said anchoring member comprises a shank button.

6. The method of releasably closing an open upper of an article of footwear as recited in claim 4, wherein said anchoring member is selected from the group consisting of a snap, a clip, a hook, a loop, a clip, a clasp, a buckle and a button.

* * * * *